US006234360B1

(12) United States Patent
Böckmann et al.

(10) Patent No.: US 6,234,360 B1
(45) Date of Patent: May 22, 2001

(54) DISPENSER OF PASTE MATERIAL

(75) Inventors: Alfons Böckmann, Dinklage; Günter Pohlmann; Ludger Südkamp, both of Lohne; Alfred von Schuckmann, Kevelaer, all of (DE)

(73) Assignee: RPC Bramlage GmbH, Lohne (DE)

( * ) Notice: Subject to any disclaimer, the term of this patent is extended or adjusted under 35 U.S.C. 154(b) by 0 days.

(21) Appl. No.: 09/353,885

(22) Filed: Jul. 15, 1999

(30) Foreign Application Priority Data

Jul. 16, 1998 (DE) ..... 198 31 957

(51) Int. Cl.[7] ..... G01F 11/00
(52) U.S. Cl. ..... 222/327; 222/389; 222/494
(58) Field of Search ..... 222/326, 327, 222/386, 389, 494

(56) References Cited

U.S. PATENT DOCUMENTS 3,843,028 * 10/1974 Whitehead ..... 222/494
4,846,810 * 7/1989 Gerber ..... 222/494

FOREIGN PATENT DOCUMENTS 3512649 10/1986 (DE) .
4326108 2/1995 (DE) .
0368062 5/1990 (EP) .
0648180 4/1995 (EP) .
8301244 * 4/1983 (WO) ..... 222/389
8904798 * 6/1989 (WO) ..... 222/494

* cited by examiner

*Primary Examiner*—Joseph A. Kaufman
(74) *Attorney, Agent, or Firm*—Friedrich Kueffner

(57) ABSTRACT

A dispenser of paste material, such as toothpaste, having an outer housing with an open upper side and a dome at the lower side, the roof of which dome includes the closing body of an air entry valve, which air entry valve displaces into the open position when there is a negative pressure within the outer housing, the dispenser also having an inner housing that protrudes upwardly from the outer housing and which includes an application surface and a nozzle opening on its headpiece, wherein the inner housing can be pushed, using the application surface, against the spring force of a bellows that is disposed in the outer housing, itself being sealed off from the inner housing, the result being that, when this force application of force takes place, a transport slug, which travels within the inner housing in the direction of the nozzle opening, pushes material ahead of itself in response to air pressure that has accumulated behind it. In order to simplify the construction of the air entry valve and increase functional reliability, the closing body is fashioned as a disc that is attached to the roof and is formed from the material of the bellows.

9 Claims, 5 Drawing Sheets

DISPENSER OF PASTE MATERIAL

BACKGROUND OF THE INVENTION

1. Field of the Invention

The present invention relates to a dispenser of paste material, such as toothpaste, that has an outer housing with an open upper side and a dome at the lower side. The roof of the dome bears a closing body of an air entry valve. The closing body is pushed into an open position in the presence of a negative pressure in the outer housing. The dispenser also has an inner housing that projects upwardly from the outer housing. The inner housing, on its headpiece, has an application surface and a nozzle opening. Via the application surface, the inner housing can be pushed in opposition to the spring force provided by a bellows in the outer housing, the outer housing itself being sealed off from the inner housing, with the result that, when this application of force takes place, a transport slug, which travels within the inner housing in the direction of the nozzle opening, pushes material ahead of itself in response to air pressure that has accumulated behind it.

2. Description of the Related Art

A dispenser of the type described above is known from EP 0 648 180 B1. The air entry valve disclosed therein is comprised of a strip, made from rubber or synthetic material, that is fastened at the edges at both ends. The strip extends over a centrally disposed airflow opening in the roof of the dome. The strip, at its periphery, extends in the dispensing direction by way of a collar. For securing purposes, a valve chamber, formed as a pot, is closed by way of a cap that can be snapped in place. The valve chamber is perforated. The cap covers the valve body and limits its curvature.

Beyond this, the prior art also presents peripherally hinged valve shutters as well as ball valves. The former concept presupposes a high level of precision in assembly, while ball valves have the disadvantages associated with inlet components that experience excessive force.

An object of the present invention is to simplify a conventional dispenser in terms of the manner in which its the air entry valve is constructed, as well as to increase the dispenser's functional reliability.

SUMMARY OF THE INVENTION

In practice, this object is achieved handily in connection with a dispenser in which the closing body is formed as a disc, which itself is formed from the material of the bellows and is attached to the roof of the dome. This results in a closing body that can be installed with exceptional economy and that possesses increased functional reliability. The positional memory of the material used for the spring function of the bellows in question is now, at the same time, sensibly exploited so that the closing body has similar positional memory.

Forming a disc is undertaken without difficulty, whereby, in view of the closing body being disposed on its valve seat surface and in view of the attachment of both components, it proves to be favorable that segments, which lay against the roof and run towards the upper rim of the bellows, extend from the disc. The segments function as securing strips well-suited for positioning purposes and guarantee proper arrangement during assembly.

A further advantageous embodiment is realized by way of severing points between the interface with the bellows and the segments that extend from the disc. Because of these, decoupling takes place so that the bellows may assume its intended spring function, acting away from the housing. To ensure the positioning of the disc, a feature is adopted to the effect that the disc is positioned on the roof by way of pegs or the like that protrude from the roof. These positioning pegs serve a function of penetration.

In accordance with one basic embodiment, there is a central positioning peg for the disc that, at the same time, lies in the middle of a central ring of valve apertures.

The act of positioning can also take place apart from the disc, such as by way of several positioning pegs in the vicinity of the segments.

Since connection in the manner of a stem cannot be accomplished with mushroom-shaped pegs, an advantageous solution is provided in that the positioning pegs are reformed as rivets after they have undertaken their penetrating action. In this connection, their ends are thermally transformed into rivet heads; of course, a suitable thermoplastic material is involved.

With mounting technique and stabilization in mind, it is advantageous if the upper rim of the bellows assumes a U-shaped cross-section that is gripped all about by the inner housing and if its portion that slides along the surface of the dome lies under the severing point of an angled end of the segment. The consequent stabilization of this area of connection accords the segment a point at which severing can later take place whereby the closing body and the bellows will separate from one another the first time the dispenser is used. Moreover, this provides a one-time attachment that is hidden from view. Subsequently, the unit comprising the disc and bellows serves a supplemental function in which the lower brim of the bellows, itself formed as a creased bellows, is braced between the lower rim of the outer housing and a screw cap of the dome by way of an outwardly oriented annular shoulder. The lower brim thus functions as an annular seal.

An advantageous process for making a dispenser involves, first, molding the dome and bellows separately and, next, turning the bellows inside-out over the roof of the dome in such a way that segments from the disc of the closing body will be centered about positioning pegs that protrude from the dome roof. In accordance with this type of penetrating function, it is consequently the case that, after the form-fitting securement on the positioning pegs takes place, the severing point between the upper rim of the bellows and the segments is cut. This is an alternative to the "prospective" severing point discussed above.

DESCRIPTION OF THE PREFERRED EMBODIMENTS

Figure 1:
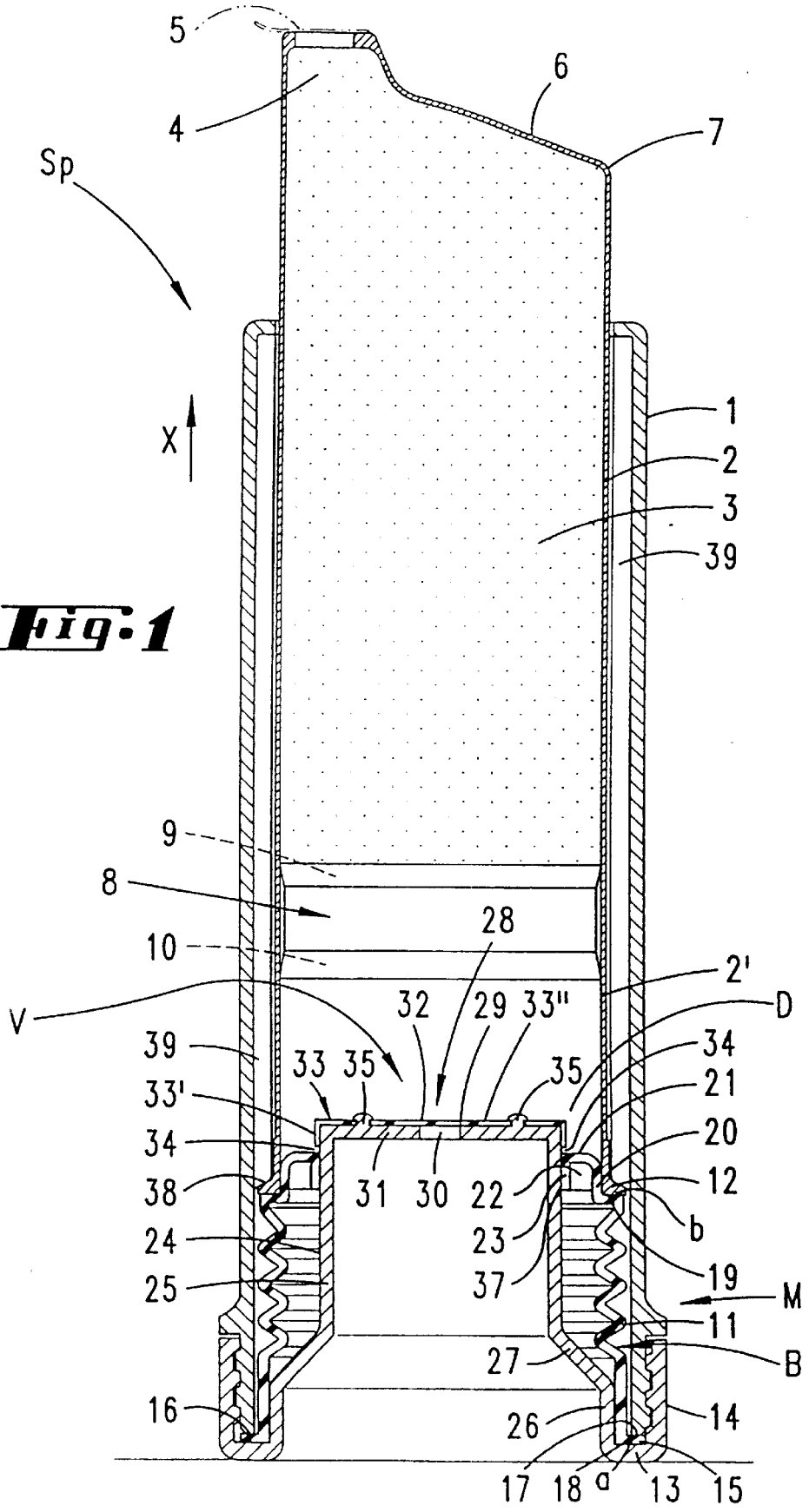
FIG. 1 is an enlarged elevational cross-sectional view of the inventive dispenser in a base position.

The illustrated dispenser Sp is in the form of a stand-up unit. It includes an elongated cylindrical outer housing 1, which accommodates therein an inner housing 2 that runs in the axial direction.

With reference to the inner housing 2, a sleeve-like construction is involved, and this contains the paste material to be dispensed. As far as the material 3 is concerned, it can involve the use of toothpaste, cream or even food. The sleeve-like inner housing is essentially formed as a cup and, at one end, has a completely open cross-section. The open-sided end is oriented downwardly, as shown in the drawing. The other end of the inner housing 2, which is for the most part closed, forms a lateral nozzle opening 4 that has a one-time stop 5. The stop, for this purpose, can be realized as a type of plug or simply as a piece of foil that is sealed and has grippable surfaces.

An application surface 6 is disposed adjacent the nozzle opening 4. The former is part of a head piece 7, which in turn is formed from the upper free end of the inner housing 2 that protrudes from outer housing 1. The direction of force application is discernible from the arrow P in FIG. 2. When such a force is applied, a dispensing mechanism M of dispenser Sp operates to displace a transport slug 8 in stepwise fashion. The slug pushes the paste material 3 in the dispensing direction (arrow X), and thus towards nozzle opening 4, with its forward side 9.

Displacement of the transport slug 8 occurs in the presence of an air pressure load, particularly when accumulated excess air pressure acts on the back of transport slug 8. The rear side of the transport slug 8, which accepts the pressure load, bears reference numeral 10. The region in which the excess air pressure is produced is indicated at Z.

The excess air pressure is built up by way of bellows B. Bellows B is embodied by a creased bellows that is compressible in the direction of arrow P. Bellows B is formed from a material that has positional memory, such as rubber or a rubber-like synthetic material. The creases of bellows B are indicated at 11 and form a basically cylindrical wall-like partition.

Bellows B functions as a rearward support spring. It acts against a lower, wide brim 12 of inner housing 2. Bellows B itself is braced against an annular bottom 13 of a screw cap 14 of dispenser Sp. The bracing region also serves as a seal a. The corresponding sealing action is brought about by the elasticity of the material.

A base brim 15 of the bellows B forms a sealing ring. This is embodied by an outwardly protruding annular shoulder 16 that is disposed between the lower edge 17 of outer housing 1 and the floor 18 of a groove in the annular bottom 13 of screw cap 14. Between the lower brim 12 of the wall cross-section 2' of inner housing 2 and the bellows B attached underneath, a seal is formed that is discernible by reference label b. This seal is located between the flat underside of the lower brim 12 and a flat, parallel, corresponding upper ring shoulder 19 of bellows B. What results is a horizontal, circumferential gradation. The sealing material here also derives from bellows B.

Progressing from the horizontal annular shoulder 19, bellows B continues as a stem-like extension 20. It protrudes into the lower, open end of inner housing 2, perhaps as a result of a one-time fitting or maybe upon insertion into a refill cartridge. The sleeve-like wall of the stem-like extension 20 is cylindrical. This wall, at the same time, lies in sealing contact with the corresponding cylindrical inner surface of inner housing 2 in the vicinity of the region D in which excess air pressure is produced.

The entire upper rim 21 of bellows B, which derives from the stem-like extension, has a U-shaped cross-section. The "U-space" that opens into the direction of the ring bottom 13 bears reference numeral 22. While the upper rim 21 provides an upwardly progressing side portion of the U-shaped cross-section of the sealing portion of the stem-like extension 20, the portion 23 of the "U" that progresses downwardly in parallel in the opposite direction forms a longitudinal guide. Portion 23, for its part, slides along a surface 24 of a dome 25 that is fixed in place and that is shaped as a cylinder over the entire stroke of the guided travel undertaken by portion 23.

Dome 25 is an integral component of screw cap 14. It is formed as a recess into screw cap 14 in the direction of the transport slug and is connected with the inner side of annular bottom 13. The foundational region, at this point, is also realized, above all, as a cylinder. Its annular wall bears the reference numeral 26. The inner side of the base brim region of bellows B is braced against the surface of cylinder 26. Base brim 15 thus cannot squeeze out. From here, annular wall 26 progresses into a frustoconical transitional wall section 27. This section is connected with the aforementioned dome 25 that has the cylindrical surface 24.

A valve V, in particular an air entry valve, is disposed on dome 25. This valve opens during a state of negative pressure in the pump-like dispensing mechanism M. Among the components of the aforementioned air entry valve is a closing body 28 that can be displaced into an open position. Dome 25 serves as part of the air entry valve V, particularly as a valve seat 29. In accordance with the basic embodiment (FIG. 1), valve seat 29 is defined about a centrally disposed aperture 30 of dome 25.

Figure 7:
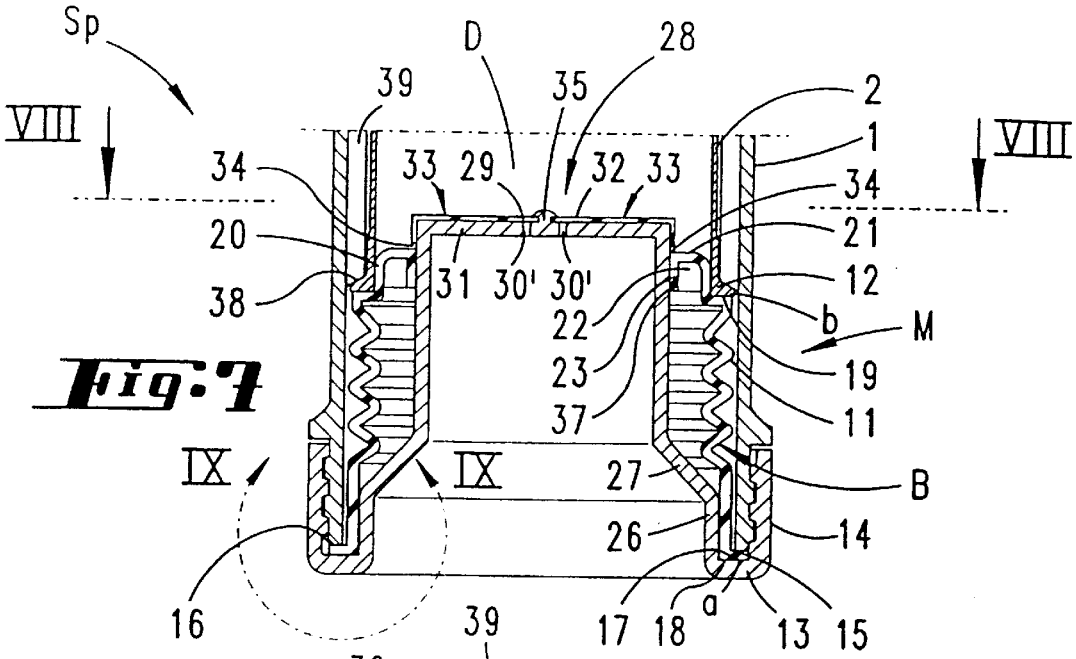
FIG. 7 is a different rendering of the lower part of the dispenser shown in FIG. 1, in which a variation on the relative positioning of the bellows and screw cap is rendered.
Figure 8:
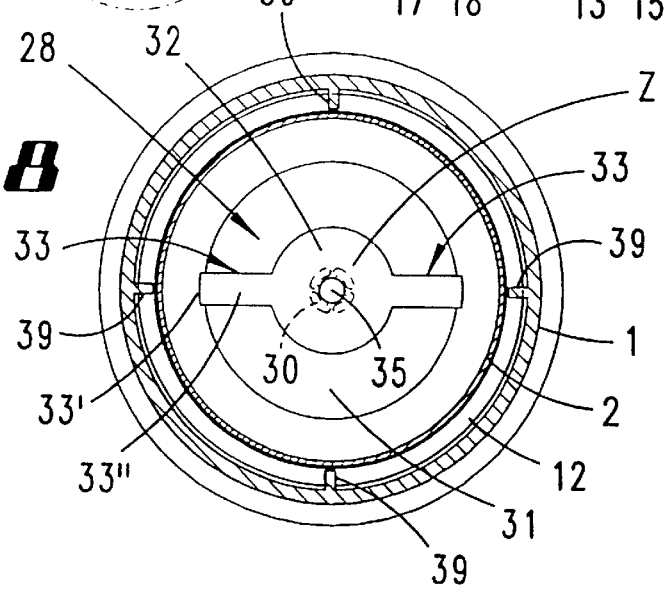
FIG. 8 shows the view taken along line VIII—VIII in FIG. 7.
Figure 9:
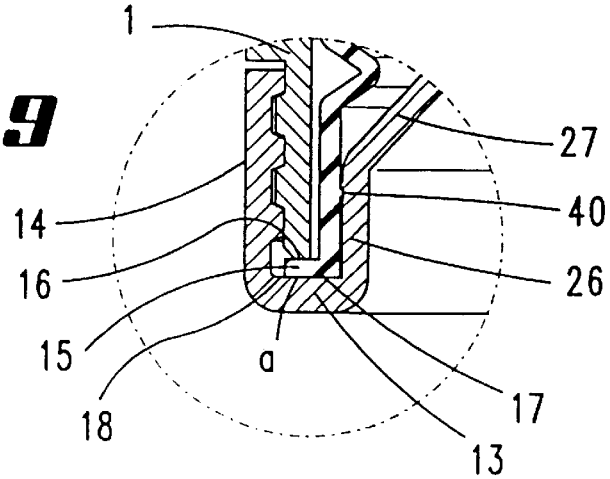
FIG. 9 shows an enlargement taken from FIG. 7.
Figure 12:
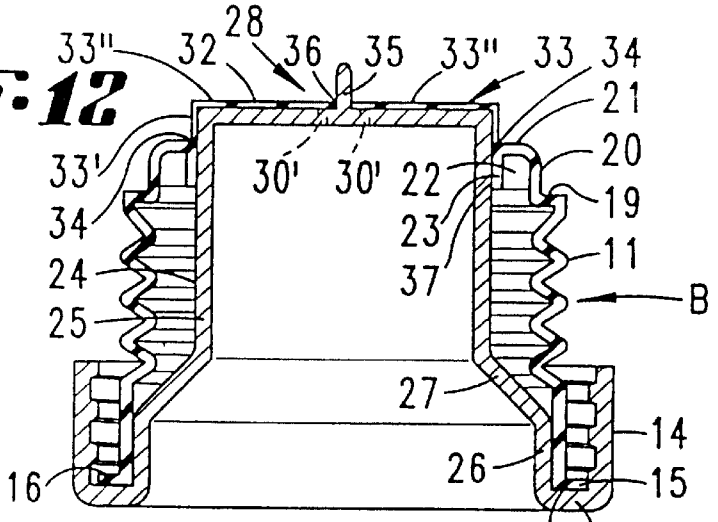
FIG. 12 shows an elevational view of the bellows and screw cap unit set in position.
Figure 13:
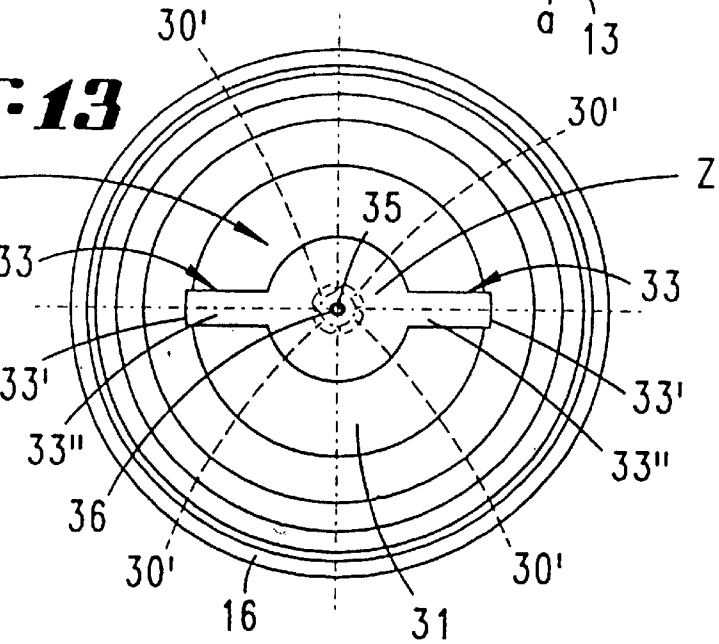
FIG. 13 shows the corresponding plan view.

The variants of this basic embodiment involve a ring of valve apertures 30' that define valve seat 29 (see FIGS. 7 and 8 for comparison). There, one will find that four arcuate slits of equivalent arc length are provided. These lie along an imaginary circular path.

Aperture 30, as well as the elongated holes of valve aperture ring 30', are formed in a roof 31 of dome 25. Roof 31 lies horizontally and bears closing body 28 in the form of a disc 32 that is attached to roof 31. Disc 32 is formed from the material of the bellows B. This represents a significant development. Progressing from the disc 32 that lies on the roof 31 of dome 25, segments 33 lead towards bellows B. What is involved are bridges of material each in the form of a band. The material bridges are severable. Indicated at 34 are the severing points between the connection with bellows B and the segments 33 that protrude from disc 32.

The severing action can take place upon use of the dispenser Sp. In this case, the severing points 34 are in the form of prospective severing points. They will tear off from the upper rim 21 of bellows B when the dispenser is first used. The upper rim 21 of bellows B will have the tensile strength necessary for this purpose, as provided in the aforementioned U-shape of upper rim 21. The U-portion 23 is formed as a guiding collar and functions, for this purpose, as a rotationally symmetrical, circumferential securing rib. It will be apparent that the severing point 34, by way of U-portion 23, lies under an angled end 33' of segment 33, which end 33' lies in the same direction.

Figure 3:
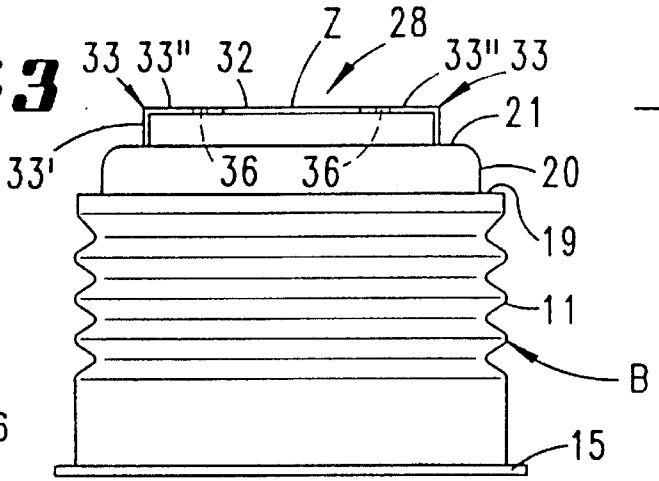
FIG. 3 is a further further rendering of the bellows, in an isolated side view.
Figure 4:
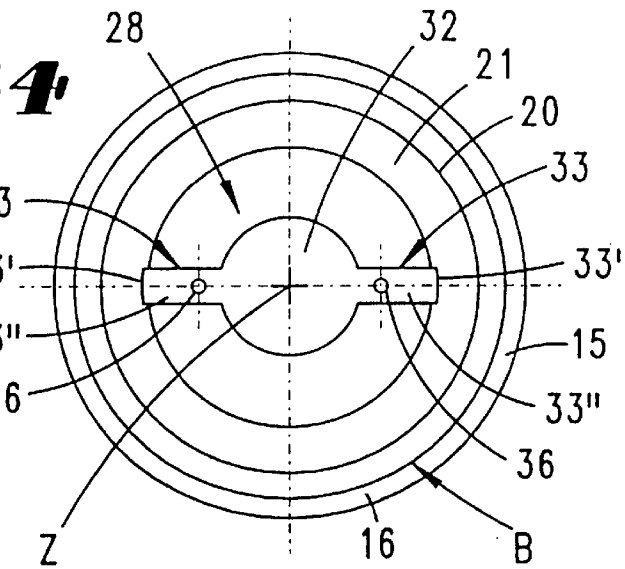
FIG. 4 shows the corresponding plan view.
Figure 10:
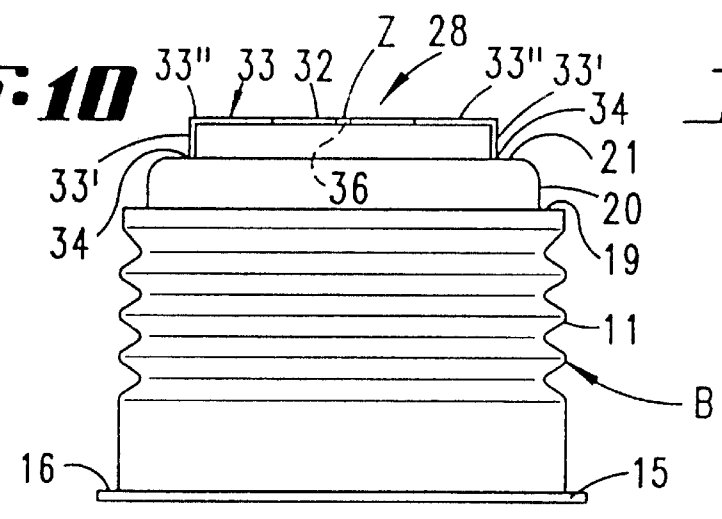
FIG. 10 shows a side view of the corresponding bellows in rendered in isolation.
Figure 11:
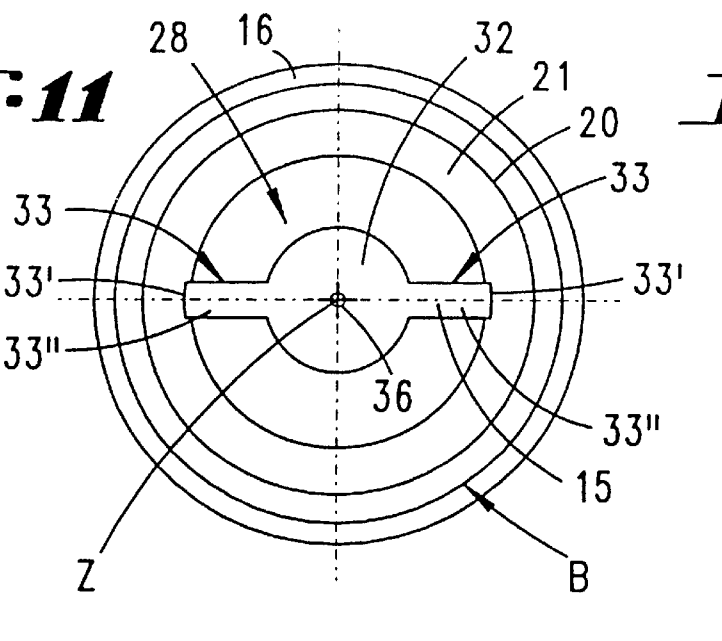
FIG. 11 shows the corresponding plan view.

The horizontal section 33" of segment 33 runs over the top of the roof and in parallel thereto. With relation to the center Z of the roof, this section 33" runs in a diametral direction. The lie of the segment 33 around a corner lends itself to a favorable securing action when cutting takes place, which also bears significance to the hoop shape of that part of the bellows B that will serve as the valve. The hoop shape or bridges, of a shape comparable to disc 32 and segments 33, lend themselves well to being interpreted from FIGS. 3 and 10.

Figure 5:
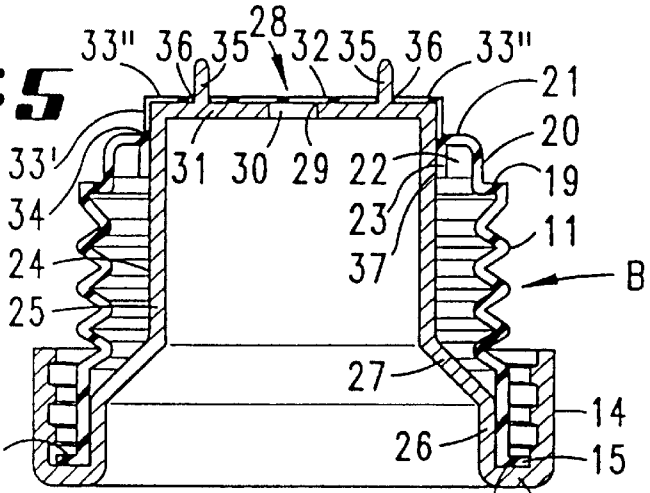
FIG. 5 shows the preformed bellows and screw cap unit, both fixed in position by pegs.
Figure 6:
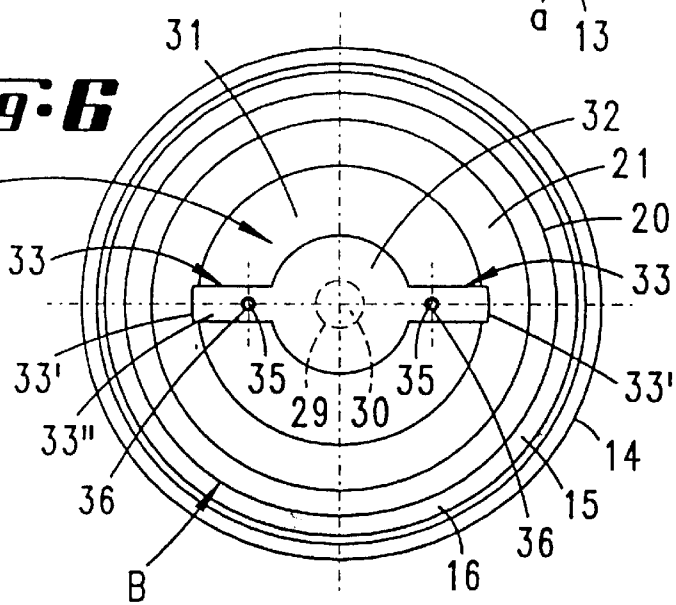
FIG. 6 shows the corresponding plan view.

The separation of the functional components constituted by closing body 28 and bellows B (as a seal and as a rear support spring) can also take place by cutting the segment 33. This type of severing lends itself to a securing of the disc 32. The disc 32 is held upon dome 25 without any particular medium of attachment. In this connection, some protruding pegs are provided on the upper side of roof 31. These lend themselves, in the realm of molding, to being formed simultaneously with the screw cap 14. In accordance with a main embodiment (FIG. 5), two positioning pegs 35 of this type are provided. Each of these accommodates a breach 36 in segment 33. This embodiment provides for a securing function that goes beyond the circumferential severing of disc 32. Once the bellows B is mounted, the free ends of the positioning pegs 35, which project through the breaches 36, are shaped as rivets. In this connection, a thermally appropriate material is involved.

In contrast, an embodiment of the invention provides for only one place where the disc can be attached. This is located at the center Z of the roof 31. The single positioning peg 35, which can be formed with a somewhat greater cross-section, is concentrically surrounded by the ring of valve apertures 30'. Strictly speaking, the apertures 30' run close to the center of roof 31.

All centering pegs 35, at their ends, have a conicity that lends itself to penetration. The rivet head, as it is formed, will lay forth so that its growing underside will assume a continually increasing width over the edge of the breach 36. The result is a functionally reliable attachment of closing body 28.

A method of formation proceeds in such a way that, to start, the dome 25 (i.e. the screw cap 14) and the bellows B are molded separately with respect to one another. Next, the bellows B is turned inside-out over the roof of the dome 25 in such a way that the segments 33 of the disc of the closing body 32 will, via correspondingly placed breaches 36, be centered about the positioning pegs 35 that protrude from the dome roof 31. A corresponding situation takes place with a variant in which disc 32 itself has a breach 36 at its center Z, into which a single positioning peg can proceed. Once the form-fitted fixing takes place about the positioning pegs 35, the severing point 34 between the upper rim 21 of the bellows B and the segment 33 is created, for example, via cutting.

Figure 2:
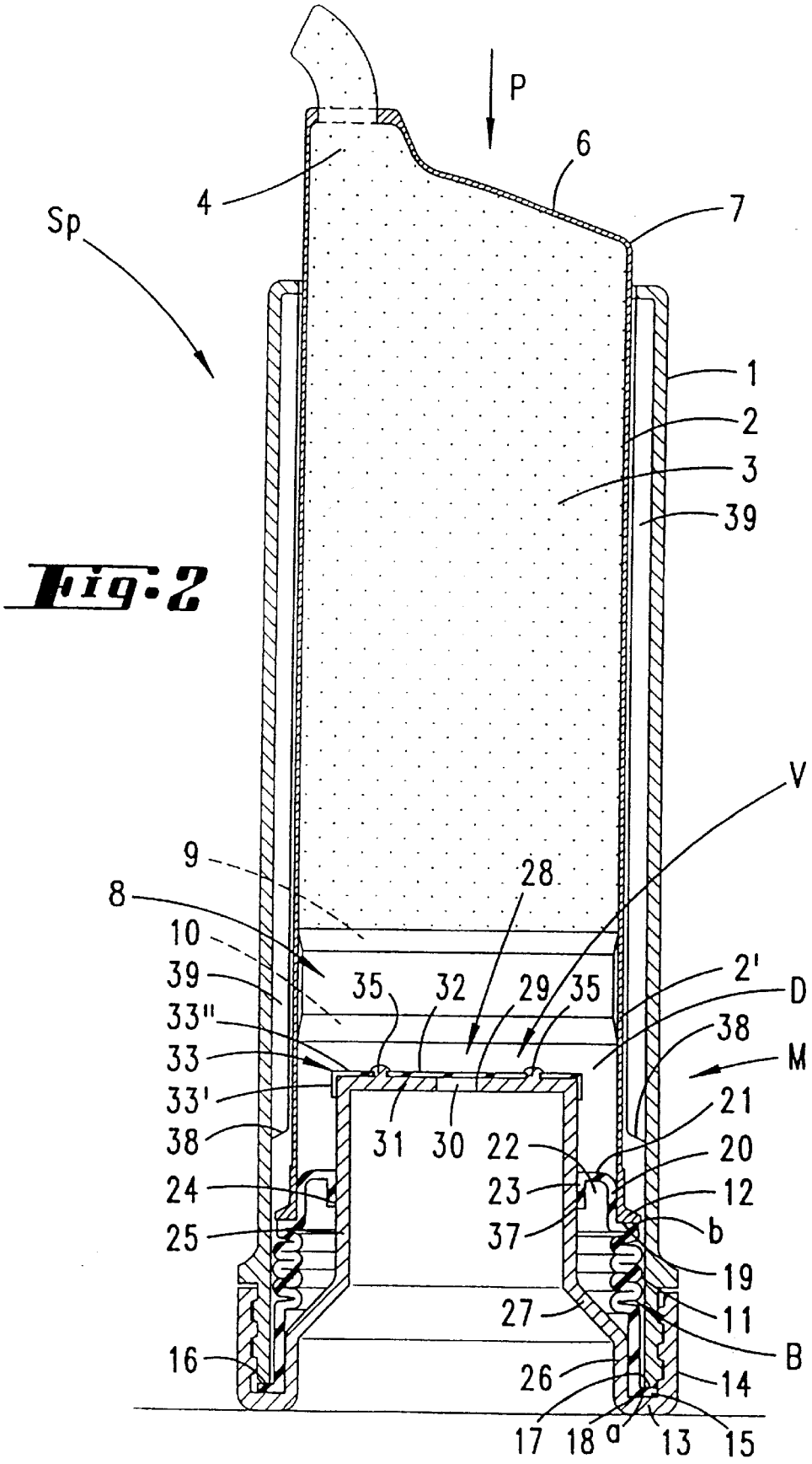
FIG. 2 is the same view of a dispenser in use.

The function and use of dispenser Sp will now be explained. When the dispenser Sp is not empty, a force upon the head piece 7 in the direction of arrow P is utilized for the purpose of dispensing, in portioned manner, the contents of the dispenser. This results in an abundance of pressure on the dome 25 and, consequently, will essentially result in a reduction in the volume of the region D of the dispenser in which negative air pressure builds up. This can take place whether the entire stroke distance available to the dispensing mechanism M or only part of it is covered. Valve V will be in the closed position. Maximal compression is illustrated in FIG. 2, whereby the creases 11 of Bellows B lie against one another in a stack. In this connection, the volume of region D will decrease. The quantity of air contained in bellows B can be exhausted through an annular gap 37 between the dome wall 24 and the bellows portion 23. The compressed and confined air will apply a force to the rear side 10 of transport slug 8. Slug 8 will push material 3 through nozzle opening 4 in stringlike form. This action will take place against the rearward force provided by the creased bellows, which acts as a pressure spring and is sealed off externally.

At this point, the application surface 6 will be released and the spring force of bellows B will push the inner housing 2 onward in the direction of arrow x. This displacement is limited. The rim 12 of inner housing 2 accepts the impact. Rim 12 progresses towards an impact medium 38 of outer housing 1. As far as this impact medium 38 is concerned, it is embodied by the angled and downwardly pointing ends of several guide ribs 39 that are located on the inner side of the cylindrical inner housing 2. These guide ribs 39 can especially be appreciated from FIG. 1. They provide a guide surface, albeit a minor one, between the outer housing 1 (of dispenser Sp) that serves as a guide and the inner housing 2 (of dispenser Sp) that is guided.

A somewhat minor sinking action of the paste material 3 and transport slug 8 provides a fortuitous effect in that a residual leftover quantity of an essentially protruding portion of material 3 will be sucked back into the nozzle opening 4. As a rule, however, it will be ensured that the air cushion will not escape from valve V since the reduced axial distance between the rear side 10 and the upper side of annular bottom 13 permits enough of an air cushion to be developed that valve V, essentially a flat valve, will be pressed into sealing contact with the valve seat 29 formed at the edges of apertures 30, 30'.

Conversely, by way of aperture 30 or apertures 30', air pressure equilibrium occurs throughout the volume from which material was relinquished. Once the inner housing 2 is in its stroke-limited base position, it can be ready to undergo further displacement for further dispensing, and so on.

To fill the apparatus, either the first time or as a refill, screw cap 14 is screwed off and a new refill cartridge is inserted. This is done most expediently by pointing the dispenser head downward. During insertion, the action of screwing in the screw cap will bring bellows B into contact with the cartridge and also with wall section 2'. Region D will be hermetically sealed. A preliminary compression taking place in region D, as early as the insertion of stem-like extension 20, contributes to the development of an air cushion. The dispenser will be ready for use.

With the annular wall 26 in place, the inner side of the bellows will have a continuous circumferential annular bulge 40 that forms an additional seal, as well as securement for bracing, for the stem-like preliminary assembly of components B and 14.

While specific embodiments of the invention have been shown and described in detail to illustrate the inventive principles, it will be understood that the invention may be embodied otherwise without departing from such principles.

What is claimed is:

1. A dispenser of paste material, said dispenser comprising:

an outer housing having an upper side and a lower side, said upper side being open and said lower side comprising a dome;

said dome comprising a roof;

an air entry valve;

said air entry valve including a closing body, said closing body being disposed at said roof of said dome;

said air entry valve being adapted to displace into an open position when there is a negative pressure within the outer housing;

an inner housing protruding upwardly from said outer housing, said inner housing including a headpiece, said headpiece comprising an application surface and a nozzle opening;

said outer housing being sealed off from said inner housing;

a bellows disposed in said outer housing;

a transport slug being disposed within said inner housing and being adapted to displace in the direction of said nozzle opening upon said inner housing being pushed at said application surface against the spring force of said bellows and to push material ahead of itself in response to air pressure that has accumulated behind said transport slug;

wherein said closing body comprises a disc being attached to said roof of said dome; and said disc is formed from the same material as the material of said bellows.

2. The dispenser according to claim 1, further comprising:

segments extending from said disc;

said segments being disposed against said roof of said dome;

said bellows comprising an upper rim;

said segments extend towards said upper rim of said bellows.

3. The dispenser according to claim 2, wherein said segments are connected with said bellows, further comprising points of severing between said segments and the points of connection of said segments with said bellows.

4. The dispenser according to claim 3, further comprising:

at least one peg protruding from said roof of said dome;

said at least one peg being adapted to position said disc on said roof.

5. The dispenser according to claim 4, wherein:

said air entry valve comprises a central ring of valve apertures;

said at least one peg comprises a central positioning peg being disposed at the center of a said central ring of valve apertures.

6. The dispenser according to claim 4, wherein said at least one peg comprises a plurality of positioning pegs disposed, respectively, in the vicinity of each of said segments.

7. The dispenser according to claim 4, wherein said at least one peg is formed as at least one rivet.

8. The dispenser according to claim 3, wherein:

said upper rim of said bellows has a U-shaped cross-section that is gripped circumferentially by said inner housing;

said U-shaped cross-section including a sliding portion that is adapted to slide along the surface of said dome;

at least one of said segments comprising an angled end;

at least one of said severing points being disposed at said angled end;

said sliding portion being disposed under said at least one of said severing points.

9. The dispenser according to claim 1, further comprising:

a screw cap associated with said dome;

wherein said bellows includes creases and further comprises a base brim; and wherein said base brim comprises an outwardly oriented annular shoulder that is braced between said lower edge of said outer housing and said screw cap.

* * * * *